US005752315A

United States Patent [19]

Sleasman et al.

[11] Patent Number: 5,752,315

[45] Date of Patent: May 19, 1998

[54] GRINDER PUMP STATION AND METHOD OF MANUFACTURE THEREOF

[75] Inventors: Andrew P. Sleasman, Gansvoort; George A. Earle, III, Ballston Lake; Clark A. Henry, Scotia, all of N.Y.

[73] Assignee: Environment One Corporation, Schenectady, N.Y.

[21] Appl. No.: 648,435

[22] Filed: May 15, 1996

Related U.S. Application Data

[62] Division of Ser. No. 284,890, Aug. 2, 1994, Pat. No. 5,562,254.

[51] Int. Cl.[6] ..... B23P 15/00

[52] U.S. Cl. ..... 29/888

[58] Field of Search ..... 241/285.1; 29/888.02, 29/888.023, 888, 890.036, 428; 264/506, 508, 150; 138/121, 122, 173; 210/532.2

[56] References Cited

U.S. PATENT DOCUMENTS

| | | | |
|---|---|---|---|
| Re. 28,104 | 8/1974 | Grace . | |
| 3,390,224 | 6/1968 | Wyatt . | |
| 3,390,225 | 6/1968 | Couch et al. . | |
| 3,538,209 | 11/1970 | Hegler | 264/508 |
| 3,667,692 | 6/1972 | Grace . | |
| 3,741,393 | 6/1973 | Estes et al. . | |
| 3,857,517 | 12/1974 | Grace et al. . | |
| 3,858,813 | 1/1975 | Hiller . | |
| 3,904,131 | 9/1975 | Farrell, Jr. et al. . | |
| 3,996,323 | 12/1976 | Hegler et al. | 264/508 |
| 4,014,475 | 3/1977 | Grace et al. . | |
| 4,255,909 | 3/1981 | Söderström . | |
| 4,345,996 | 8/1982 | Lindman et al. . | |
| 4,709,723 | 12/1987 | Sidaway et al. . | |
| 4,790,975 | 12/1988 | Jarvenkyla et al. | 264/508 |
| 4,793,387 | 12/1988 | LeBlanc et al. . | |
| 4,822,213 | 4/1989 | Grace et al. . | |
| 4,919,343 | 4/1990 | Van Luik, Jr. et al. . | |
| 5,046,886 | 9/1991 | Muir et al. . | |
| 5,095,667 | 3/1992 | Ryan et al. . | |

FOREIGN PATENT DOCUMENTS

| | | |
|---|---|---|
| 970667 | 9/1964 | United Kingdom . |

OTHER PUBLICATIONS

Hydromatic Poly Basin System, Aurora Pump, 1993.
Hydromatic Poly Basin System, 1993.

*Primary Examiner*—Mark Rosenbaum
*Attorney, Agent, or Firm*—Heslin & Rothenberg, P.C.

[57] ABSTRACT

A grinder pump station capable of having its height adjusted in the field during installation has a longitudinal tank having a substantially cylindrical non-corrugated inner wall secured to a substantially cylindrical corrugated outer wall, a separate transition section for mounting a grinder pump unit within the longitudinal tank, a removable lid assembly attached to the top of the longitudinal tank, and a base attached to the bottom of the tank. A grinder pump unit may be mounted inside of the tank. The removable lid assembly includes an electrical and ventilation interface for the grinder pump unit mounted in the tank, thereby facilitating adjustment of the height of the tank through variation in its longitudinal extent without interference with the electrical and ventilation interface. The transition section separates an upper tank portion from a lower tank portion, preferably has a non-corrugated side wall, and includes a sewage inlet opening and a sewage outlet opening through its side wall.

11 Claims, 3 Drawing Sheets

GRINDER PUMP STATION AND METHOD OF MANUFACTURE THEREOF

This application is a division of application Ser. No. 08/284,890 filed Aug. 2, 1994, now U.S. Pat. No. 5,562,254.

BACKGROUND OF THE INVENTION

1. Technical Field

The present invention generally relates to grinder pumps. More particularly, the present invention relates to stations used to house grinder pumps.

2. Background Information

Today, low pressure sewer systems, powered by grinder pumps, are a desired alternative to conventional gravity sewer systems and septic tank use. Sewage grinder pump systems are now a widely accepted and popular means for handling residential waste, where conventional gravity sewer systems may not be practicable, or are expensive, requiring high priced materials and significant labor. Environmental concerns have also forced many communities to seek alternatives to both conventional gravity sewer systems and septic tank use. By keeping costs at a minimum and providing effective wastewater storage, conditioning, and transport, grinder pump systems provide a rational and cost effective alternative to conventional wastewater management systems.

While the costs associated with the installation, operation, and maintenance of grinder pump systems are significantly less than that of conventional gravity sewer systems, grinder pump installation remains a significant component of the overall cost of a sewage grinder pump system. Prior to installation of a grinder pump, an engineer or surveyor will typically determine the height of a housing for the grinder pump, also called a grinder pump station, needed for a particular site. Notwithstanding this pre-installation height determination, it is common to encounter obstructions in the field, e.g., a bed of rocks, etc., requiring at times a more expensive excavation and installation effort. An alternative to additional excavation is modification of the height of the grinder pump station in the field.

In the past, fiberglass has been the preferred material for grinder pump stations. While non-corrosive fiberglass has performed its function satisfactorily, several disadvantages are now apparent. First and foremost, fiberglass is a relatively expensive material. Height modification in the field is also difficult with fiberglass stations. Typically, height adjustment is limited to large increments, such as, eighteen inches. Large incremental modifications, however, do not provide adequate flexibility in adjusting height of grinder pump stations in the field.

Another disadvantage associated with fiberglass grinder pump stations is that after installation, the smooth walled fiberglass may be pushed or driven by buoyant groundwater forces, causing the stations to "float" from their installed location. In order to prevent such movement, concrete ballasting of the stations is often necessary. Concrete ballasting, however, requires a greater excavation and installation effort, ultimately adding additional expense. Another problem encountered with fiberglass grinder pump stations is groundwater leak paths which may emerge through the walls of the stations. These leak paths tend to occur where inlet, outlet, and interface openings are prepared in the field during installation.

Fiberglass grinder pump stations also have a limited tolerance to mishandling, which commonly occurs during shipment and installation. Transport and installation is often rough, and as a result, fiberglass stations may suffer structural damage during handling. Unfortunately, however, station damage may not be ascertainable until after installation is complete and leaking begins. Fiberglass also has a limited ability to withstand the abrasive effects associated with sewage slurry.

In order to compensate for the various drawbacks associated with fiberglass stations, it is believed that stations made of other materials are now available. One known non-fiberglass grinder pump station includes a rotationally molded station formed from polypropylene. While this known station avoids the usage of fiberglass, it retains many of the drawbacks associated with fiberglass stations, including difficult field height adjustment and limited structural integrity. In addition, this rotationally molded polypropylene station is not available with the grinder pump installed therein, and therefore, installation in the field remains laborious. Installation of the grinder pump in the field also aggravates the emergence of ground water leak paths through the various inlet and outlet openings of the station created during installation.

Thus, a need exists for a grinder pump station which possesses improved structural integrity, enjoys simple installation, allows field height modification in small increments without interfering with electrical and ventilation interfaces, and is highly resistant to corrosion, all at a reasonable cost.

SUMMARY OF THE INVENTION

Briefly, the present invention satisfies this need and overcomes the shortcomings of the prior art through the provision of a grinder pump station capable of having its height adjusted in the field during installation, which includes: a longitudinal tank having a substantially cylindrical non-corrugated inner wall secured to a substantially cylindrical corrugated outer wall; means for mounting a grinder pump unit within the longitudinal tank; a removable lid assembly for attachment to the top of the longitudinal tank; and a base attached near the bottom of the longitudinal tank. The lid assembly includes an electrical and ventilation interface for a grinder pump unit to be mounted in the longitudinal tank.

Preferably, the longitudinal tank has an upper portion and a lower portion. A transition section having a non-corrugated outer wall separates the upper portion of the longitudinal tank from the lower portion. The transition section has a sewage inlet opening and a sewage outlet opening. The transition section also includes means for mounting and supporting the grinder pump unit in an aligned position within the tank.

Typically, the interface openings of the lid assembly include an interface hole sized for an electrical cable and an interface aperture sized for a ventilation pipe. The electrical cable is attached to a remote power source, and provides electrical energy for the grinder pump unit mounted inside of the grinder pump station. Preferably, the electrical cable includes an electrical quick disconnect and a breather device. In order to maintain ambient pressure inside a control housing of the grinder pump unit, the breather device permits air to flow into the electrical cable but prevents liquid from entering. In order to accomplish this function, a shield is used which permits gas and vapor to pass therethrough, while preventing liquid from passing. Preferably, the shield is made of a fabric impermeable to liquid water but permeable to air.

In another aspect, the grinder pump station of the present invention, capable of having its height adjusted in the field during installation, may include: a tank having an upper end and a lower end; means for mounting a grinder pump unit within the longitudinal tank; a base secured to the longitudinal tank near the lower end of the tank; and a removable lid assembly attachable to the upper end of the longitudinal tank, the lid assembly having an electrical interface for the grinder pump station, wherein when the lid assembly is removed, the height of the tank can be adjusted in the field by varying length of the longitudinal tank without interference with the electrical interface.

It is therefore, an object of this invention to provide a grinder pump station having easy field height adjustability.

It is another object of this invention to provide a grinder pump station having field height adjustability in small increments.

It is yet another object of this invention to provide a grinder pump station having all interface openings located in such a manner as to facilitate field height adjustability.

It is a further object of this invention to provide a grinder pump station which is easy to install.

It is yet another object of this invention to provide a grinder pump station which reduces flotation beneath the ground, thereby eliminating or reducing the need for concrete ballasting.

It is still another object of this invention to provide a grinder pump station which requires lower manufacturing and material costs over existing fiberglass stations.

It is another object of this invention to provide a grinder pump station which performs well in a hostile and corrosive environment.

It is another object of this invention to provide a grinder pump station, including a grinder pump unit, which is substantially factory assembled, thereby reducing the amount of field labor necessary for installation.

These, and other objects, features and advantages of this invention will become apparent from the following detailed description of the preferred embodiment taken in conjunction with the accompanying drawings.

DETAILED DESCRIPTION

Figure 1:
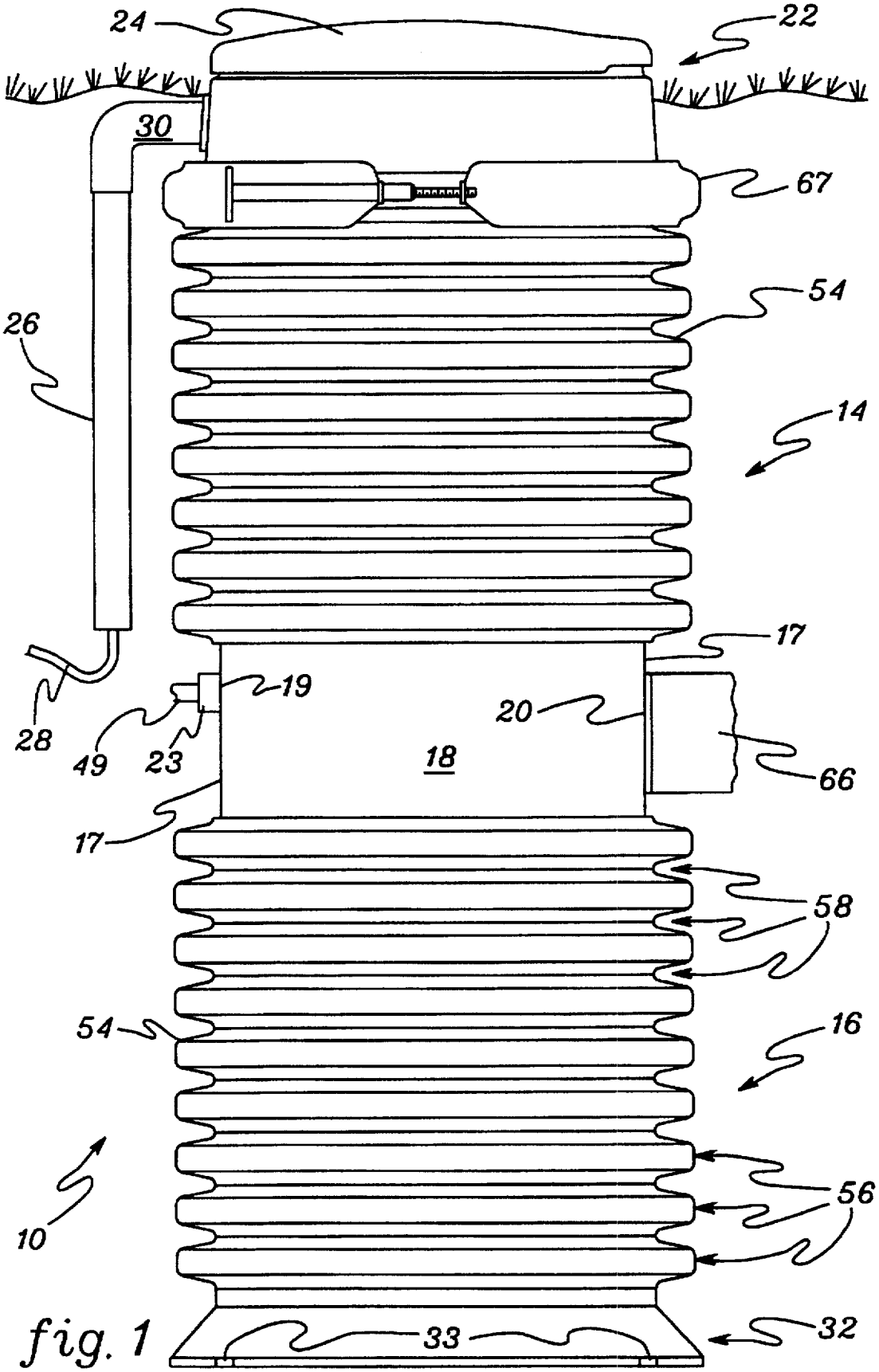
FIG. 1 is a side view of a grinder pump station, constructed in accordance with the principles of the present invention, installed underground in the field.

Referring now to the drawings, and more particularly to the exterior view of FIG. 1, a grinder pump station 10 is positioned substantially vertically in the ground. Grinder pump station 10 includes a lid assembly 22, an upper tank portion 14, a transition section 18, a lower tank portion 16, and a base 32. The outer side walls of upper tank portion 14 and lower tank portion 16 are corrugated, while the outer side wall 17 of transition section 18 is preferably smooth. Extending through side wall 17 of transition section 18 is an inlet opening 20, through which sewage enters grinder pump station 10, and a discharge opening 19, through which processed sewage exits grinder pump station 10. Attached to the upper tank portion 14 is a lid assembly 22. Lid assembly 22 includes the electrical and ventilation interfaces of the grinder pump station, as more fully described hereinafter, and an access hatch 24 for allowing a person access to the interior of grinder pump station 10. A protective conduit 26, attached to one side of lid assembly 22 by a protective shield 30, provides a protective housing for an electrical power cable 28. A base 32 is secured to the lower portion 16 of grinder pump station 10. In the preferred embodiment, each of the aforementioned components, i.e., upper tank portion 14, lower tank portion 16, transition section 18, lid assembly 22, and base 32, are separately constructed and attachable to one another via various methods, which will later be described in detail.

Figure 2:
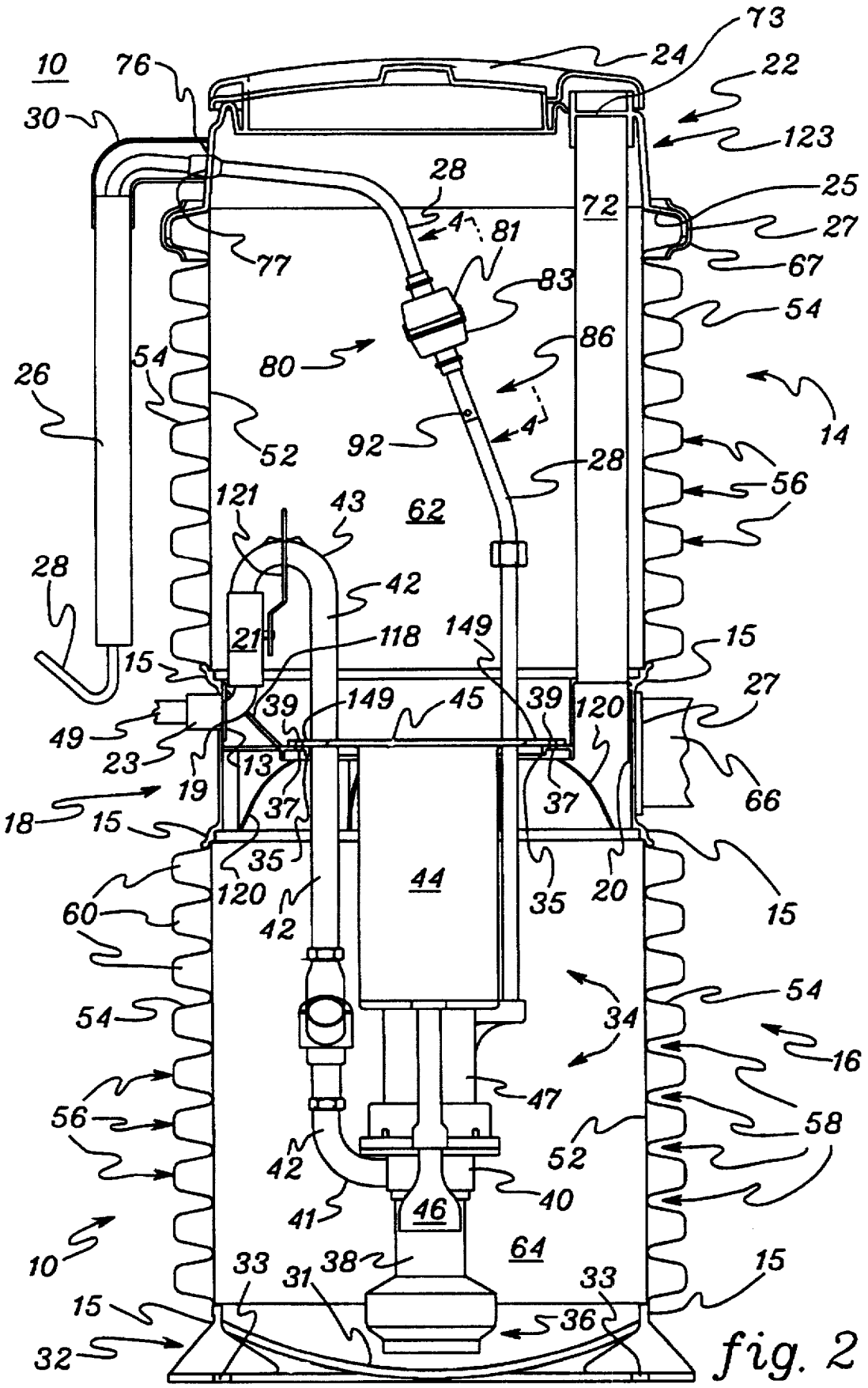
FIG. 2 is a side sectional view of the grinder pump station of FIG. 1, having a grinder pump unit installed therein.

FIG. 2 is a side sectional view revealing the interior of grinder pump station 10. Mounted within grinder pump station 10 is a grinder pump unit 34. Grinder pump unit 34 includes a grinder head 36 for pulverizing sewage. A grinder pump 38 is mechanically secured to grinder head 36 for pumping ground sewage through grinder pump station 10. Grinder pump 38 includes a discharge housing 40, which is joined to a discharge outlet pipe 42. A liquid tight and air tight control housing 44 houses the controls for grinder pump 34 (e.g., pressure switches, start relays, etc.), and underneath housing 44, a motor housing casting 47 houses an electric motor (not shown) used for powering both grinder pump 38 and grinder head 36. Grinder pump unit 34 employs one or more sensing tubes 46 to sense pressure variations by measuring increases in the level of sewage collected in grinder pump station 10. Upon the attainment of a predetermined sewage level, the motor within motor housing casting 47 will be energized. The sewage collected in grinder pump station 10 will then be ground by grinder head 36 and thereafter pumped by grinder pump 38 from discharge housing 40 to discharge outlet pipe 42. From discharge outlet pipe 42, the processed sewage will travel to a remote location, e.g., to a pressure sewage main and ultimately to a sewage treatment plant. For more detailed information regarding the construction and operation of a grinder pump unit similar to the one shown in FIG. 2, refer to U.S. Reissue Patent 28,104, issued to Grace, commonly owned by the assignee of the present invention, Environment One Corporation, and entitled PUMP STORAGE GRINDER, the disclosure of which is hereby incorporated by reference in its entirety.

A preferred embodiment of the tank portions 14 and 16 of grinder pump station 10 will now be described. Preferably, upper tank portion 14 and lower tank portion 16 are identical in every respect, apart from their relative height. Both upper tank portion 14 and lower tank portion 16 have a substantially cylindrical non-corrugated inner wall 52 secured to a substantially cylindrical corrugated outer wall 54. As viewed from the side in FIGS. 1 and 2, corrugated outer wall 54 is shaped like a wave, forming a series of alternating crests 56 and troughs 58. Preferably, each trough 58 of corrugated wall 54 is secured, during the manufacturing process, to inner wall 52. In the preferred embodiment, an extrusion method of manufacture is employed to form the corrugated configuration, wherein the cylindrical corrugated outer wall 54 and cylindrical inner wall 52 integrally form double walled upper tank portion 14 and lower tank portion 16. The preferred double-walled corrugated configuration provides structural stiffness and rigidity. Also, the double-walled construction is less susceptible to puncturing. After installation in the ground, soil will tend to become lodged between alternating corrugations, thereby anchoring station 10 securely therein, in turn eliminating or reducing the need for concrete ballasting. Preferably, tank portions 14 and 16 are constructed from a thermoplastic, such as high density polyethylene. High density polyethylene is preferred because it possesses the following characteristics: resistance to environmental stress cracking; cold temperature duracorrosive resislity; corrosive resistance to a wide variety of chemicals; impact resistance; and mechanical strength.

In the event that an obstruction is encountered during installation in the field, the height of upper tank portion 14 may be modified by an installer who may simply utilize a common tool, such as a hand saw, to cut off unnecessary tank length. Preferably, the installer would remove the uppermost corrugation or the uppermost series of corrugations from upper tank portion 14. If the installer needs to remove only one corrugation, the uppermost corrugation would be cut at the lower trough of the uppermost corrugation. By cutting off only one corrugation, the height of grinder pump station 10 may be reduced by approximately 3⅛ inches, which is the length corresponding to one corrugation of the preferred embodiment. While one corrugation is currently set at approximately 3⅛ inches, it is understood that other units may be fabricated which have a different corrugation length, thereby allowing for a finer height modification. If additional length needs to be removed upper tank portion 14, the installer may cut off a series of corrugations. In the event that station height is too short, additional length may be added to upper tank portion 14, through the provision of a known watertight coupling (not shown) which is coupled to a tank extension (not shown) of identical construction to tank portions 14 and 16. One such watertight coupling is manufactured by Advanced Drainage Systems of Ludlow, Mass.

Each corrugation in upper and lower tank portions 14 and 16 defines a hollow cavity 60 extending around the periphery thereof. It should be understood, however, that each cavity 60 may be filled. For purposes of economy of manufacture and reduction of overall station weight, the hollow cavity corrugation is preferred. It should also be understood that the upper and lower tank portions may under certain circumstances comprise a smooth outer wall and/or single wall construction provided that the wall affords sufficient structural strength. However, from the standpoints of cost and structural stiffness, the doubled-walled construction with corrugated outer wall configuration is preferred.

Inside grinder pump station 10, a dry well 62 and a wet well 64 are defined by the inner wall of upper tank portion 14 and the inner wall of lower tank portion 16, respectively. Thus, dry well 62 is an internal cavity corresponding to upper tank portion 14, and wet well 64 is an internal cavity corresponding to lower tank portion 16. Transition section 18 provides a barrier between dry well 62 and wet well 64. Grinder pump unit 34 is secured to transition section 18 and aligned inside wet well 64 along the longitudinal axis of tank portions 14 and 16. Sewage passes from an inlet pipe 66 to inlet opening 20 of transition section 18 and into wet well 64, where the sewage is thereafter processed in grinder pump unit 34. For greater detail on the operation and construction of the dry well and wet well aspect of the present invention, refer to U.S. Pat. No. 4,014,475, issued to Grace et. al, commonly owned by the assignee of the present invention, Environment One Corporation, and entitled COMBINED MANWAY AND COLLECTION TANK FOR SEWAGE GRINDER, the disclosure of which is hereby incorporated by reference in its entirety.

Separating upper tank portion 14 from lower tank portion 16 is transition section 18, which is preferably a separately manufactured and attachable component of grinder pump station 10. Transition section 18 is substantially cylindrical in shape, has a non-corrugated outer wall to facilitate the formation of one or more inlet openings 20 and discharge opening 19 through its sides, and has an enlarged axial opening extending therein. As shown in FIG. 2, inlet opening 20 is preferably diametrically opposite to discharge opening 19. Both inlet opening 20 and outlet opening 19 are formed directly in the wall of transition section 18 to avoid the need for any penetrations to be made during installation in the field. Preferably, a synthetic rubber grommet 27 or the like is used at inlet opening 20 to facilitate the coupling of inlet pipe 66, such as standard PVC piping. Discharge outlet pipe 42 extends from discharge housing 40 of grinder pump unit 34, elbows around at 41 for vertical displacement through wet well 64 (alongside grinder pump unit 34), passes up into dry well 62, elbows around again at 43, and connects to the top of a vertically situated conventional ball valve assembly 21. A valve handle 121, attachable to ball valve assembly 21, provides the means for closing the ball valve during removal of the grinder pump unit 34 from station 10. Pipe 42 thereafter extends from the bottom of ball valve assembly 21, where it attaches to a flange 13, which is located adjacent to opening 19. A sealing grommet (not shown) may be used in conjunction with the discharge plumbing herein described to facilitate a leak tight seal. A discharge hub 23 is fitted to opening 19 to facilitate the connection of a field installed pipe 49. Typically, during installation in the field, the installer will connect pipe 49, which ultimately hooks up to a sewage main or the like.

Transition section 18 includes structure for positioning and aligning grinder pump unit 34 in grinder pump station 10. Axially extending opening of transition section 18 accommodates the axial insertion therein of grinder pump unit 34. Transition section 18 includes an inner diameter and an outer diameter. The inner diameter is defined by the axial opening, and the outer diameter is defined by outer side wall 17. An internal conical wall 118 forms the upper interior portion of transition section 18, where conical wall 118 flares inward from the outer diameter to a proximity near the inner diameter of the transition section. This conical shape provides structural stiffness for transition section 18 and facilitates the insertion of grinder pump unit 34 into the axial opening of transition section 18. Also to facilitate the structural stiffness of transition section 18, a plurality of gussets 120 may fan outward from the inner diameter to a proximity near the outer diameter of the bottom of transition section 18.

Grinder pump unit 34 is suspended in wet well 64 through the support of transition section 18. To facilitate the attachment of grinder pump unit 34 to transition section 18, a peripheral ledge 35 of transition section 18 receives a peripheral flange 149 of a top plate 45 of grinder pump unit 34. Top plate 45 is integral to control housing 44 of grinder pump unit 34. The peripheral ledge 35 includes a plurality of equally spaced threaded inserts 37, each of which aligns with a corresponding plurality of equally spaced apertures 39 of peripheral flange 149. Core bolts (not shown) pass through apertures 39 and thread to threaded inserts 37, thereby mechanically securing and sealing top plate 45 of grinder pump 34 to transition section 18. Preferably, an airtight and watertight connection will be achieved.

Preferably, transition section 18 is manufactured by using an injection molding method of manufacture. Also, it is preferred that transition section 18, like upper tank portion 14 and lower tank portion 16, be constructed of a thermoplastic, such as high density polyethylene. Transition section 18 is a separately manufactured component of grinder pump station 10, separate from both upper tank portion 14 and lower tank portion 16 to which transition section 18 is joined. Numerous techniques have been developed for joining thermoplastic materials, such as high density polyethylene, of which upper tank portion 14, lower tank portion 16, transition section 18, and base 32 are preferably composed. For instance, an electric fusion welding technique, also known as a resistive method of welding, may be used to secure together the individual thermoplastic components of grinder pump station 10. For greater detail on this technique of joining, refer to the disclosure of Canadian Patent Number 1,248,729, entitled ELECTRIC FUSION WELDING OF THERMOPLASTIC, which issued on Jan. 17, 1989 to Butts, et al. Alternatively, an inductive welding technique may be used. Extrusion welding is also another known technique for joining thermoplastic components together. Joining of the components may also be accomplished by mechanical means in conjunction with secondary sealing adhesives. To facilitate the mating of transition section 18 to upper tank portion 14 and lower tank portion 16, the top and bottom edges of transition section 18 may have a peripheral bevelled edge at 15, thereby providing greater surface contact for mating components. It should be noted that the above techniques for connection may be used on various joints, including lap joints, butt joints, and combination lap/butt joints.

Removably attached to the top of upper tank portion 14 is lid assembly 22. Lid assembly 22 is preferably circular in cross-section, and has an enlarged opening located axially therethrough to accommodate access hatch 24. As seen best in FIG. 2, lid assembly 22 has a substantially vertical sidewall 123, which flares out at 25, then returns to a substantially vertical position at 27. At its outermost cross-sectional diameter, lid assembly 22 has a greater diameter than corrugated tank portion 14. The greater diameter and the flared out configuration of sidewall 123 at lower end 27 facilitates the connection of lid assembly 22 to upper tank portion 14, as more fully described hereinafter.

Access hatch 24 is secured to lid assembly 22 and provides a convenient opening for access to dry well 62. Access hatch 24 includes a gasket (not shown) which is preferably friction fit to lid assembly 22, providing a leak-tight seal. Access hatch 24 includes an outer face which is exposed to the atmosphere. The outer face of access hatch is preferably dome shaped and may include a series of channels 29 to facilitate the draining of liquids, such as water. Access hatch 24 may be fitted with a means for locking access hatch 24 to lid assembly 22. Access hatch 24 is preferably made of a non-corrosive material, such as fiberglass reinforced polyester, and manufactured by compression molding. Various other methods of manufacture may also be utilized.

Figure 3:
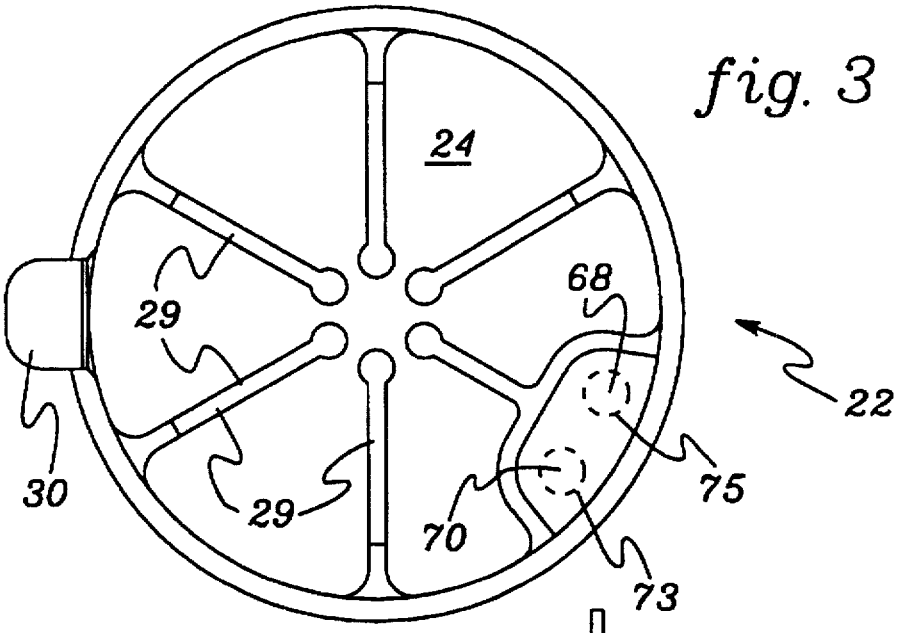
FIG. 3 is a top view of a lid assembly of the grinder pump station of FIG. 1 and FIG. 2.

Various ventilation and electrical interface openings preferably pass through lid assembly 22. For example, as shown in the top view of FIG. 3, a dry well interface aperture 68 provides ventilation to the atmosphere for dry well 62, and a wet well interface opening 70 provides ventilation to the atmosphere for wet well 64. The electrical and ventilation interface openings preferably pass through lid assembly 22, and not tank portions 14 or 16, to facilitate ease of field height adjustability. Both interface vent openings 68 and 70 are preferably located through the top of lid assembly 22. Attached to wet well interface opening 70 is an elongated ventilation pipe 72 (FIG. 2) which passes through dry well 62 and extends through transition section 18 and opens into wet well 64. Wet well interface opening 70 may have a rubber grommet (not shown) molded therein to facilitate attachment of pipe 72. Near the top of ventilation pipe 72, a shield 73 may be employed to prevent liquid from entering pipe 72 while permitting the flow of vapor therethrough. A second shield 75 may be employed in the same manner as shield 73, but to prevent liquid from entering dry well 62. Shields 73 and 75 are desirable to prevent water from entering the interior of grinder pump station 10 during accidental flooding. Both shields 73 and 75 may be made of a fabric impermeable to liquid water yet permeable to air and vapor. A preferred material for shields 73 and 75 is GORE-TEX, which is a trademark for a fabric most widely known and used as "breathable" rainwear and winter clothing. Ventilation pipe 72 permits toxic and explosive gases, e.g., methane, to safely escape from wet well 64 to the atmosphere. Also, ventilation pipe 72 provides for the maintenance of atmospheric pressure within wet well 64. Preferably, lid assembly 22 is fabricated from a non-corrosive material, such as a fiberglass reinforced polyester, and made by a compression molding method of manufacture. It should be understood, however, that other methods of manufacture, including injection molding and structural foam molding, may be employed in the construction of lid assembly 22.

Electrical interface opening 76 may also pass through lid assembly 22. Preferably, electrical interface opening 76 passes through the side of lid assembly 22. An airtight and watertight sealing means 77, such as a gasket, grommet or the like, is secured within interface opening 76. An electrical cable 28, housing a plurality of electrical conductors, is remotely connected to a power source (not shown) and provides electrical power to grinder pump unit 34 of station 10. Electrical cable 28 may pass within protective conduit 26 and shield 30 and then through sealing means 77 of electrical interface opening 76, into and through dry well 62 and top plate 45, to electrical control housing 44, ultimately providing electrical energy for the operation of grinder head 36 and grinder pump 38. Electrical cable 28 is jacketed with a leaktight cover. A conventional electrical quick disconnect 80, having a female connector 81 and a male connector 83, is employed with cable 28. In the event accidental flooding occurs inside dry well 62, it is preferred that quick disconnect 80 be of the submersible type.

If the height of upper tank portion 14 needs to be modified, the installer would first disconnect electrical quick disconnect 80, and then remove lid assembly 22. Since all ventilation and electrical interface openings pass through lid assembly 22, the height modification of upper tank portion is not obstructed by any openings passing through upper tank 14. After lid assembly 22 is removed, the installer may cut at least one corrugation from the upper tank 14 to reduce the height of station 10, or add a watertight coupling (not shown) and tank extension (not shown) to add height to station 10. Once the proper height is achieved, lid assembly 22 may be re-attached to the top of upper tank portion 14 in a watertight and airtight manner. Preferably, lid assembly 22 is secured to the uppermost corrugation of upper tank portion 14 by applying a bead of a strong bonding adhesive between the uppermost corrugation of upper tank portion 14 and the mating portion of lid assembly 22. A stainless steel band clamp 67 (FIG. 1 and FIG. 2) may be employed to tightly fasten lid assembly 22 to upper tank portion 14. The combination of the adhesive and band clamp 67 results in a watertight and airtight seal. Various other well known means of fastening and sealing may be employed in lieu thereof.

Figure 4:
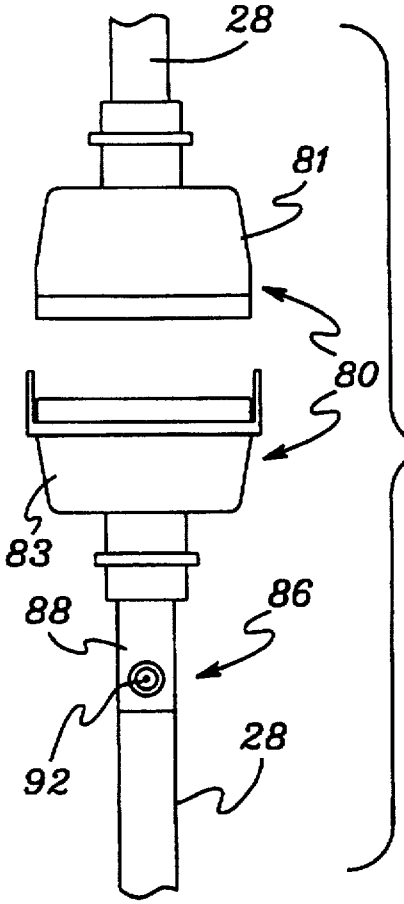
FIG. 4 is a blown up view of a breather device, an electrical quick disconnect, and an electrical cable of the present invention.
Figure 5:
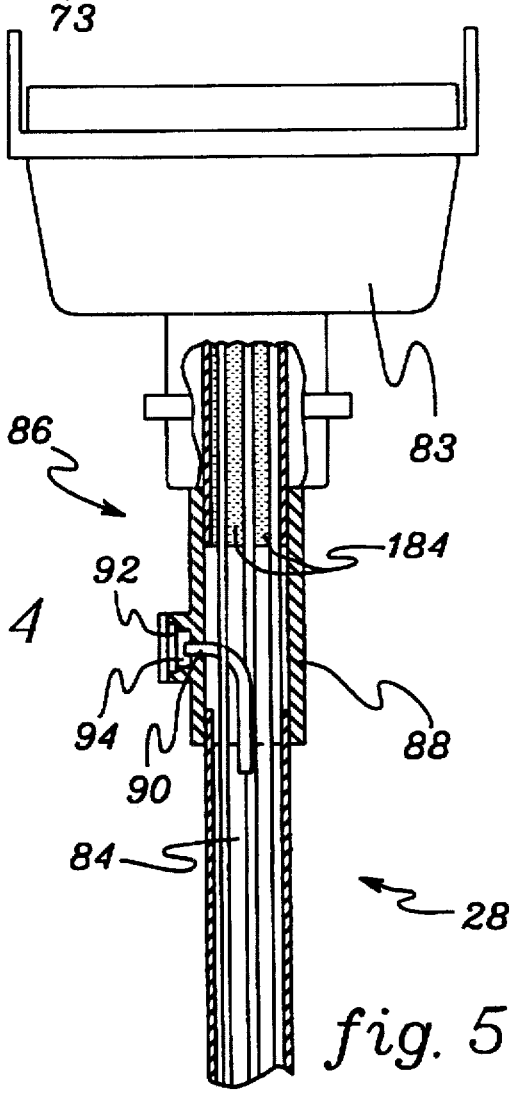
FIG. 5 is a blown up longitudinal sectional view of the breather device and electrical cable of FIG. 4.

In order to ensure the proper functioning of the control elements contained inside control housing 44, it is preferable for control housing 44 to be vented to atmospheric pressure. Providing ventilation to control housing 44 may be accomplished by employing a breather device 86 along electrical cable 28, as shown in detail in FIGS. 4 and 5. Breather device 86 permits the flow of air into an air thruway 84 of electrical cable 28, while at the same time, prevents liquid from entering therein. Air thruway 84 extends partially lengthwise through cable 28, from where breather device 86 is located on cable 28 to control housing 44. Breather device 86 may be located adjacent to electrical quick disconnect 80, as shown in FIGS. 2, 4, and 5, or other locations may be selected for the position of breather device 86 along cable 28. Preferably, air thruway 84 does not extend through the entire length of cable 28. For instance, it is not necessary for air thruway 84 to extend from a point above breather device 86 to the point where cable 28 hooks up to a power source (not shown). A potting material 184 may be used to eliminate the air thruway 84 at such locations.

The flow of air from breather device 86 to control housing 44 provides atmospheric pressure to housing 44. In the event that dry well 62 accidentally floods with water, breather device 86 prevents the flow of liquid into air thruway 84 of electrical cable 28. Breather device 86 includes a peripheral sleeve 88, which is secured leaktight around electrical cable 28. Air passageway 94 passes through one side of peripheral sleeve 88, and a tube 90 connects to air passageway 94 to ensure air passes into air thruway 84 of cable 28. While air may pass through shield 92, liquid may not. A preferred material for shield 92 is GORE-TEX.

In conjunction with breather device 86, described hereinabove, or in lieu of breather device 86, a breather valve device (not shown) may be employed to prevent water from entering control housing 44, the disclosure of which can be found in pending previously filed U.S. patent application, Ser. No. 08/060,430, commonly owned by the assignee of the present invention, Environment One Corporation, and filed on May 11, 1993. This pending previously filed U.S. patent application is hereby expressly incorporated by reference. Briefly, this breather valve device (not shown), through the provision of a pressure actuated movable float, permits the flow of air therethrough while preventing the flow of liquid therethrough.

Base 32 is secured to lower tank portion 16 by using one of the known techniques, disclosed hereinabove, for joining thermoplastic materials together. Referring back to FIG. 2, base 32 is dish-shaped, and preferably has a spherical inner bottom surface 31, which faces upward. This spherical configuration acts to gravitationally and hydrostatically force sewage slurry to a central location of base 32. More particularly, solid sewage slurry is forced under grinder head 36 for suction into grinder pump unit 34, thereby preventing the corrosive and scouring effects of stagnant hard particle sewage inside wet well 64. Base 32 includes a means for attachment to a transport brace (not shown), e.g., a pallet, to ensure rigid support during shipment. Means for attachment may include a plurality of peripherally spaced apertures 33, which receive conventional bolts.

After the manufacture of the individual grinder pump station components, described above, the individual components are secured together in the factory. For instance, upper tank portion 14 is secured to transition section 18, which in turn is secured to lower tank portion 16, which in turn is secured to base 32. Interface openings are thereafter fitted with corresponding grommets, gaskets, or the like. After factory assembly and joining of the individual components of station 10, grinder pump unit 34 is mechanically secured to transition section 18 of grinder pump station 10. Various pipes and cables are thereafter attached; for instance, discharge outlet pipe 42 which extends inside of wet well 64 and dry well 62 is attached to ball valve 21, flange 13, and a sealing grommet (not shown). Now, grinder pump station 10, including grinder pump unit 34, is ready for shipment and installation.

Prior to shipment, typically, a consulting engineer or surveyor will determine the station height required for the particular job. Once the station height is determined, the sized grinder pump station 10, including grinder pump unit 34 and associated plumbing, etc., will be transported to the site, where excavation and installation follows. If during installation in the field it is realized that an alternate station height is necessary, the height of the station may be easily adjusted. For instance, during excavation, a bed of rocks may impede the excavation process. In such a situation, the installer may avoid a more costly excavation by simply modifying the height of the grinder pump station. If the height of the station needs to be reduced, the installer simply removes the lid assembly containing the electrical and ventilation interfaces, and then uses a common tool, such as a handsaw, to cut off the unnecessary length from upper tank portion 14. In the event that additional tank length is necessary, a watertight coupling (not shown) and tank extension (not shown) may be used to add length.

While several aspects of the present invention have been described and depicted herein, alternative aspects may be effected by those skilled in the art to accomplish the same objectives. For instance, while the preferred embodiment employs a double-walled outer corrugated tank, a single walled station may be employed in certain circumstances. Furthermore, the tank may be formed of shapes other than cylindrical. In addition, while specific methods of manufacture have been disclosed herein for the various components of grinder pump station 10, various other methods of manufacture may also be appropriate. Also, while a transition section is disclosed, some grinder pump stations, especially those accommodating free standing or rail mounted grinder pump units, may operate without the need for a transition section. Accordingly, it is intended by the appended claims to cover all such alternative aspects as fall within the true spirit and scope of the invention.

We claim:

1. In a method of producing a longitudinal tank of a grinder pump station for housing a grinder pump unit that processes sewage, said longitudinal tank having an inlet opening through which sewage enters the station and a discharge opening through which processed sewage exits the station, the improvement comprising:

forming a first section of said longitudinal tank with an extruded multiple wall construction, said extruded multiple wall construction comprising a substantially cylindrical non-corrugated inner wall integral with a substantially cylindrical corrugated outer wall; and further comprising a step of forming a second section of said longitudinal tank with a substantially cylindrical non-corrugated single wall construction, and locating said inlet opening and discharge opening in said second section.

2. The improved method of claim 1 wherein said second section is formed by injection molding.

3. The improved method of claim 1 further comprising a step of joining said first section to said second section by welding.

4. The improved method of claim 1 further comprising a step of joining said first section to said second section by mechanical means.

5. The improved method of claim 4 wherein the step of joining further employs a sealing adhesive.

6. The improved method of claim 1 further comprising a step of joining the second section to and between a pair of first sections.

7. The improved method of claim 1 further comprising a step of providing said tank with means for mounting a grinder pump unit within said tank.

8. The improved method of claim 7 wherein said means for mounting a grinder pump unit within said tank is formed integral with said tank.

9. The improved method of claim 8 wherein said means for mounting a grinder pump unit within said tank comprises a ledge for supporting the grinder pump unit.

10. The improved method of claim 1 further comprising the further comprising the steps of:

providing a lid assembly attachable to an upper end of said longitudinal tank; and providing an electrical opening in said lid assembly for passage therethrough of an electrical cable for connection to said grinder pump unit.

11. The improved method of claim 10 further comprising a step of providing a ventilation opening in said lid assembly.

* * * * *